United States Patent [19]

Milsmann et al.

[11] Patent Number: 4,582,506

[45] Date of Patent: Apr. 15, 1986

[54] METHOD FOR THE PRODUCTION CONTROL ON BAG MACHINES

[75] Inventors: Klaus Milsmann, Bielefeld; Wilfried Ebmeyer, Enger, both of Fed. Rep. of Germany

[73] Assignee: Windmoeller & Hoelscher GmbH, Bielefeld, Fed. Rep. of Germany

[21] Appl. No.: 558,334

[22] Filed: Dec. 5, 1983

[30] Foreign Application Priority Data

Dec. 7, 1982 [DE] Fed. Rep. of Germany ..... 3245143

[51] Int. Cl.[4] ..... B31B 1/00

[52] U.S. Cl. ..... 493/12; 493/10; 493/19; 493/27; 198/395; 198/460

[58] Field of Search ..... 493/10, 12, 13, 14, 493/15, 17, 19, 20, 21, 27; 72/4, 5; 198/502, 460, 395

[56] References Cited

U.S. PATENT DOCUMENTS 3,433,135 3/1969 Lokey et al. ..... 493/12
4,085,928 4/1978 Sussman ..... 493/14
4,228,886 10/1980 Moran ..... 198/395
4,281,828 8/1981 McDonald et al. ..... 493/12
4,355,712 10/1982 Bruno ..... 198/460
4,364,766 12/1982 Nitschke ..... 198/460
4,416,651 11/1983 Sullivan et al. ..... 493/12

*Primary Examiner*—Francis S. Husar
*Assistant Examiner*—David B. Jones
*Attorney, Agent, or Firm*—Fleit, Jacobson, Cohn & Price

[57] ABSTRACT

Bag sections that pass through a machine are scanned as to their spatial positions within the machine. The measuring points have been arranged at distances corresponding to the stroke of the machine, so that it is possible to intervene in the operation of the machine when a deviation from a given nominal position occurs, before a stopper formation occurs. Each bag section that comes into the machine triggers a subsequent comparison of nominal and actual values in a manner such that the signals of defects that are generated by the lack of work pieces, are neutralized.

10 Claims, 2 Drawing Figures

METHOD FOR THE PRODUCTION CONTROL ON BAG MACHINES

Figure 1:
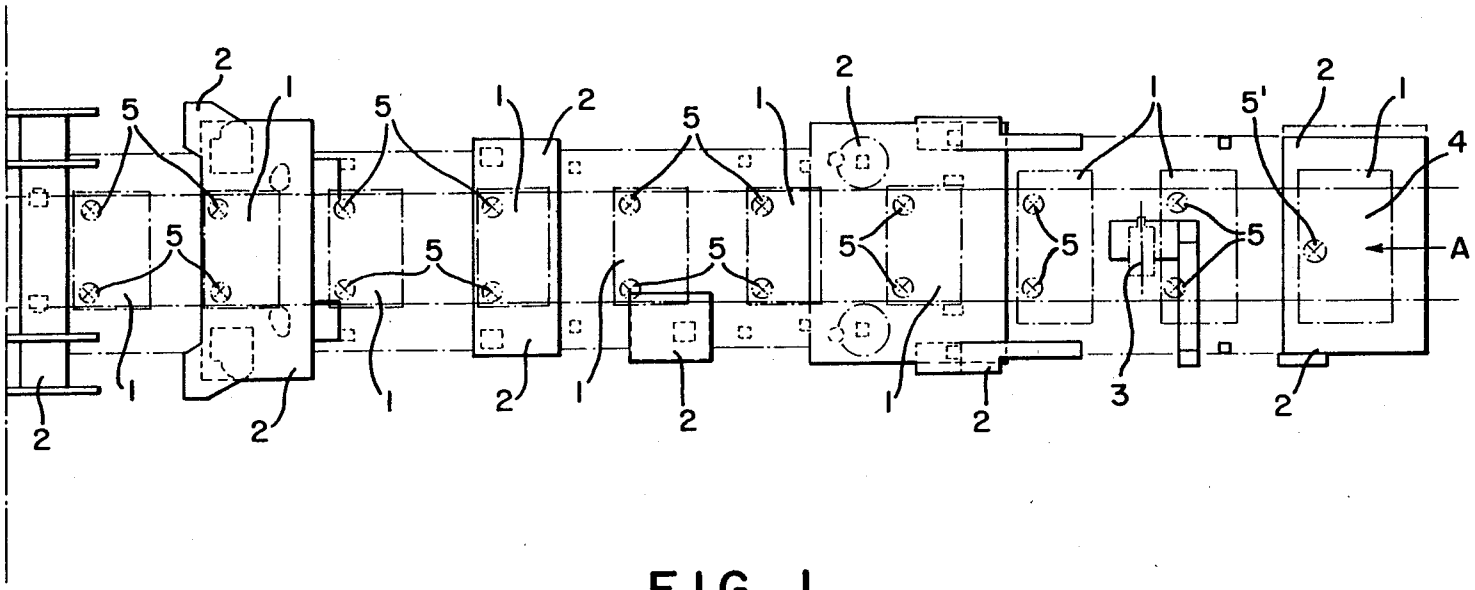

The present invention is concerned with a method for the production control on bag machines, in which the work pieces continually pass through according to the rhythm or stroke increment of the machine at distances from one another that result from the rhythm of the machine, with shut-down of the machine in the case of a defect. In addition, the invention is concerned with a device on bag machines for the execution of the aforementioned with a stopping device that responds to any case of a defect.

In the case of bag machines in which the hose sections that are to be provided with one bottom each on one or both sides, pass continually in continuous sequence by means of a conveyer, it is known to provide control rails above the conveyor path, for the purpose of switching the machine off when so-called "stoppers" occur. The control rails are designated by experts as so-called "stopper rails." When any trouble appears within the machine, e.g. due to the bunching of a hose section, the corresponding stopper rail is moved out of its control position, whereby a switch is actuated and the machine is switched off. Usually, the cause of trouble is an agglomeration of paper that causes a collision of several work pieces. In that case, the stopper rails have the task, when said agglomeration has already taken place, to prevent the subsequent hose sections from being moved into the area of agglomeration, before the operator would be able to switch off the machine. The elimination of a stopper requires relatively much time and is the more difficult as the number of hose sections forming the agglomeration increases. In addition to the loss of production, it may happen that parts of the machine are damaged.

In consequence thereof, the present invention is based on the problem of creating a method—and a device for executing said method—for acting on the machine is an adjusting manner and to guarantee, in that way, that stoppers of that kind will not occur, a priori, so as to prevent any down periods.

It is now possible, by means of the scanning of the edges, to recognize shifts in the positions of the work pieces at a time before it leads to stoppers due to the collision of several work pieces. Since the build-up of a stopper takes place within a path the length of which may vary, it is possible by the use of the method in accordance with the invention to determine the shifting of a work piece away from its original position, so that it is possible to start, even before the onset of the actual stopper formation, measures that will prevent a disturbance leading to the shut-down of the machine. The measures may be taken in regard to the magnitude of the deviation from the nominal position as well as in regard to the point where the defect within the machine is found. For example, it is possible to shut-down the machine in the conventional manner by switching-off the drive. If need be, that can also be done by means of appropriate braking in the so-called instant-stop method. In addition, there is the possiblity of initiating a modification of the running speed, preferably a reduction; in that case, there exists, beyond that, the possibility that the speed of the earlier operation will be reset automatically, when the work-pieces recorded as defective have passed through the machine. There is another possibility, viz. that the stations through which the defective work pieces will still have to pass, are put out of operation, so that waste due to defective bottom formation will be prevented. Another essential advantage may be seen in the fact that the use of the method in accordance with the invention brings about an exact formation of the bag bottom, inasmuch as the form and measurements of the formed bottom are concerned, since shifts of the hose sections that pass through can be recognized. In that way, the hose sections are moved, within an allowable limit, practically always in the same position into the devices that perform working operations on the construction of the bottom.

Another additional advantage of the invention is due to the fact that indications of defects caused by the lack of one or several work-pieces can be neutralized. In this regard, the missing of work-pieces may be due, on the one hand, e.g. to disturbance of the feed-in, and on the other hand, by the removal of an indicated defect when the machine was not in operation. In the latter instance, a new start of the operation is, therefore, given automatically, without carrying out any special measures.

In accordance with a preferred embodiment of the invention, the scanning of the leading edge of an incoming work piece is used to trigger the subsequent comparisons of nominal and actual values. In this design, it has been ensured that the nominal value is only specified when a work piece is present. In addition, it is particularly advantageous to shut down the machine, depending on the magnitude of the deviation of the actual value from the nominal value in regard to the position in space and/or to the site of the defect, by means of switching off with or without braking, inasmuch as, in this case, a normal switching-off with an appropriate slowing down of the machine is possible, so that no additional brake pressures will appear, while on the other hand, there is the possibility of shutting down the machine by means of a so-called rapid stopping device, in order to prevent the occurrence of an agglomeration of paper of more or less extensive volume. In addition, there is the possibility that the machine, depending on the magnitude of the deviation of the actual value from the nominal value in regard to the position in space and/or to the site of the defect, will continue its operation, while the original speed will be restored after a given period of time. In that way, a shutting down of the machine will become avoidable, when it can be recognized that the occurring defect would not bring about any agglomeration of paper. If a defective formation of the bottom should be a consequence thereof, that bottom will be eliminated, in any case, by the normally present bottom control in the conventional way.

In accordance with an additional, likewise preferred embodiment of the invention, it has been provided that the indication of a defect generated by the elimination of a work piece from the machine is neutralized by adopting the actual value resulting therefrom as the new nominal value for the further operation. By means of that arrangement, it is possible, when a defect appears, to withdraw one or several work pieces from the machine without complicating thereby the resumption of the operation by the signals of defects caused by the lack of the work pieces, since the arrangement that exists in the machine after the withdrawal of one or several work pieces, will be picked up by the scanners and is used as the given value for further control operation.

It is particularly advantageous that the leading edge of the work piece is scanned since it is usually considered, in bag machines, to be a reference edge inasmuch as it lies at a definite place, independently of the dimensions of the work pieces, e.g. of the width of the bags. Conventionally, the distance betwen the leading edges of two subsequent work pieces always corresponds to the stroke of the machine which is defined as follows: during one revolution of the driving shaft, that is designated as an single-revolution shaft, the chains, belts, or similar devices move over a path that corresponds to the stroke, e.g. 68 cm. In consequence thereof, the design of a corresponding machine has to be related to the determined stroke, at all times.

The pick-up of the oblique position of work pieces moving through the machine is particularly advantageous because the leading edge is scanned at two sites that are distant from one another, inasmuch as, in this case, only two scanners that are located at the same level in relation to the path of the work pieces that pass through, are required at each scanning site.

By making use of an arrangement, in accordance with the invention it is possible to carry out the operations required by monitoring the production with the help of devices that are known and have been proven in practical use, while an appropriate circuit is necessary to ensure operation in accorandce with the invention. The arrangement is, in addition, particularly safe to operate by the use of components that have proven their value in electrical engineering.

Additional characteristics and features of an advantageous development of the present invention are set forth in the following description of a preferred embodiment.

FIG. 1 schematically shows a bag machine in top view.

Figure 2:
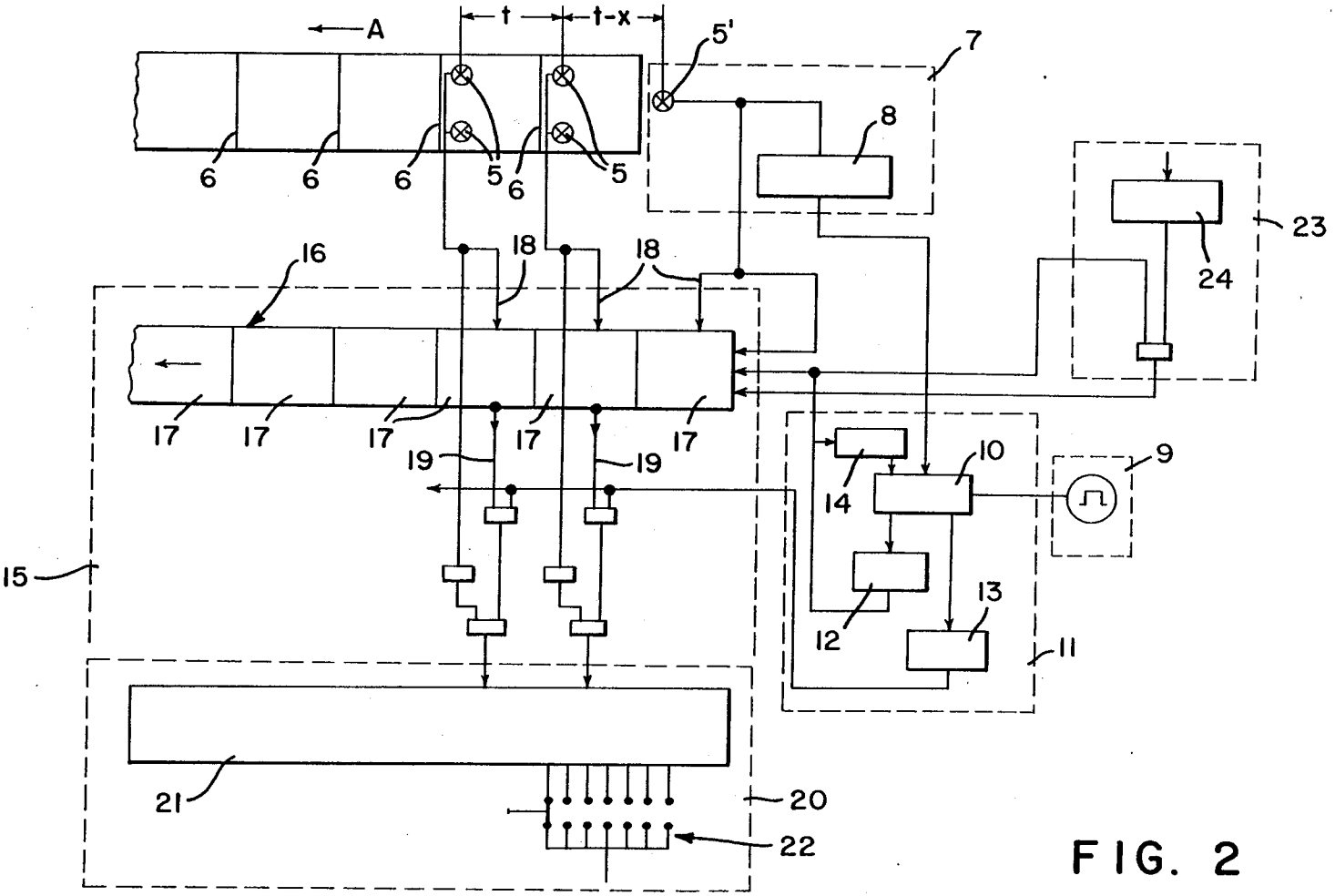

FIG. 2 shows a basic circuit diagram for monitoring the positions of work pieces in a bag machine.

In the bag machine which has been shown schematically in FIG. 1, the work pieces, which in the disclosed embodiment have to be provided with one bottom each on both sides, e.g. flat hose sections 1, are moved, in the direction of the arrow A by means of moving elements which have been shown in detail, continuously in a transverse position. The hose sections 1 which have been represented by dot-dash lines, have been drawn in smaller numbers than is actually the case, to facilitate illustration. The distance, in each case, of two consecutive hose sections 1 corresponds to the stroke of the machine. The devices that are necessary for the formation of the bottoms, are shown symbolically only in FIG. 1 and are not described in any detail and have generally been designated by the reference number 2. The bag machine is driven by a drive 3 which likewise is not shown or described in detail. As may be seen from FIG. 1, within the path of the hose sections 1, a scanning device 4 for scanning the leading edges of the hose sections 1 has been mounted. The scanning device 4 includes in the disclosed embodiment, a plurality of light sensors 5; in each case, a set of two light sensors related to the path of the hose sections 1 have been arranged at the same level and at a transverse distance from one another. In addition, the sets of the light sensor 5 each have been mounted in series forming a plurality of sensing sites, as seen in the direction of the movement of the hose sections 1, with the distance between successive sets of the light sensors corresponding to the stroke of the machine. As may be seen in FIG. 1, it follows therefrom that, at a certain point in time during the normal state of operation of the bag machine, the light sensors 5 are located immediately behind the leading edge of the pertinent hose section 1. When the light sensors 5 are activated at that point in time, the beam of light is disrupted. Since the light sensors 5 operate according to the bright-dark principle, no signal of a defect would be given in this case.

On the other hand, if a hose section 1, or several hose sections 1, should change nominal position an determined by the feed-in according to the rhythm of the machine, at least one of the pertinent light sensors 5 would not be covered any longer by the leading edge. The pertinent light sensors 5 then would produce a signal which would be evaluated as a defect. By means of the circuit which is explained in detail below, a measure then would be initiated that would correspond to the defect or to the site where the defect appears. Since the basis of the nominal position is the leading edge of each hose section 1, it is not necessary to adjust the light sensors 5 in each case to the width of the hose sections, since the leading edge is a reference edge. Further, since the bag or hose section 1 is moved by moving means such as, e.g., chains, belts, or similar devices, it can be assumed that the leading edge of a hose section 1 will not normally shift in the direction of its advancement, so that a defect of this type normally will not occur. However, in practice, it has been found that the moved hose sections 1 do shift in the reverse direction against the direction, of advancement, and the recognition of such a shift or defect is guaranteed by the present invention. That is true even when one end of a hose section 1 is displaced, so that it lies in an oblique position. In that case, a signal indicating a defect will be given, due to the arrangement of two light sensors 5 that are located at a transverse distance from one another but at the same level.

As a result of monitoring in accordance with the invention, the formation of agglomerations is largely preventable, because an agglomeration can be recognized in the preliminary phase, i.e. the phase of a shifting of one of the hose sections 1 out of the nominal position.

The shifts of the hose sections 1 that are kept within limits do not lead to any agglomeration, and a certain amount of shift is, therefore, permissible in accordance with the invention. That is achieved by having the distance between the first (as seen in the advancing direction) light sensor and the subsequent one smaller by an amount that is inconsiderable in relation to the stroke of the machine and/or the distance of the subsequent light sensor. The amount of that difference is equal to the allowable tolerance value within which, during the subsequent comparative measurements, a deviation from the nominal position is permissible. In the present embodiment, as seen in the direction of the advancing hose sections 1, an initial control step is accomplished solely by one light sensor that has been mounted approximately in the center of the machine, since it may be assumed that, at that point, no deviation from the nominal position has taken place as yet. The pertinent light sensor has been designated by the reference numer 5'.

In FIG. 2, a possible main circuit diagram is shown. The continuous passage of the work pieces has been marked by the direction of the arrow A. The leading edge—which represents the reference edge—of each hose section 1 has been designated by 6. The distance of the light sensors 5 in the advancing direction is equal to the machine stroke distance and has been designated by t. The distance between the first—as seen in the advancing direction—light sensor 5' and the subsequent light sensors 5 is smaller by an amount of x than the stroke distance t and has been designated by t-x, where x represents a tolerance value in regard to the allowable deviation from the nominal value. In FIG. 2, only the light sensor 5' and a pair of the sets of serially arranged light sensors 5 have been shown, for the sake of simplicity. The arrangement shown extends over the entire path of the hose sections 1. The light sensor 5' is part of a symbolically detecting or pick-up device 7. The light sensor 5' detects the hose sections 1 that are fed into the machine and initiates a counting run by way of a counting-run release 8 and by means of a counting mechanism 10 that is electrically connected with a transmitting device 9. The transmitting device 9 includes an impulse sender that transmits a certain number of impulses with each revolution, said number corresponding to the distance covered by the moving hose sections 1 within the machine. It is a special advantage that an impulse will be sent after a path of 1 mm. It follow therefrom that, during one stroke of the machine, a number of impulses is sent that is equal to the distance covered as expressed in mm. For example, when the machine has been designed for a stroke of 690 mm, the path covered amounts also to 690 mm, and likewise, 690 impulses will be sent.

The counter 10 is part of a symbolically shown stroke-and-counter device 11 that includes an impulse former or shaper 12 for the formation of a shift pulse, which will be explained later, an impulse former and shaper 13 forming an interrogating impulse, which will be explained later, and a return device 14 for resetting the counter 10.

In addition, a comparator 15 has been provided that consists of an electric slide register 16 with control members which have not been represented in any detail. The slide register 16 comprises a plurality of points 17, and it is necessary to provide at least as many points as hose section 1 are in the machine. When the light sensor 5' is darkened by an incoming hose section 1, the sensor sends a signal indicating the presence of the hose section to the first point 17 of the slide register 16. Following one rotation of the transmitting device 9 which takes place during one stroke of the machine, a shift pulse is triggered by the pulse former 12, and with the aid of said pulse, the signal read by the sensor 5' into the first slide register point 17 is moved ahead by one point. At the same time, the hose section 1 in the machine is moved further by one stroke, so that the subsequent—as seen in the direction of the movement—light sensors 5 will be darkened by the incoming hose section. A comparison step then is initiated by the interrogation impulse transmitted from the transmitting device 9 through the impulse former 13. For this purpose each point 17 of the slide register 16 has been provided with one of a plurality of parallel inputs 18 and with one of a plurality of parallel outputs 19, for the monitoring and determining if the parallel output of the pertinent point 17 of the slide register 16 is comparable with the output of the corresponding set of light sensors 5 within the machine. The monitoring and comparing process as described will be continued in continuous sequence, so that all hose sections, that are within the machine will be monitored. When the interrogating impulse is transmitted by the impulse sender 13, the parallel outputs 19 of the points 17 of the slide register 16 are occupied. When the hose sections 1 to be monitored have been moved properly into their nominal positions, so that the light sensors 5 are darkened, there will, when this state is picked up, be no difference in the result of the nominal-actual-value comparison, so that no signal of a defect will be generated.

On the other hand, when a hose section 1 has not been moved properly into nominal position, so that two light sensors 5 will not be darkened, or so that only one light sensor will be darkened, that means that a hose section 1 has shifted rearward against the direction of advancement, or else is in an oblique position, whereby then a signal of a defect will be generated during the comparison, said signal triggering the steps already described. The possibilities described above are shown in the basic circuit diagram according to FIG. 2.

It also is possible that the interrogating pulse produced by the impulse former 13 be transmitted, before the transmission of the shift pulse, by the pulse former 12. In that case, if it is found during the comparison that one of the light sensors 5 is already darkened, that signifies that the pertinent hose section 1 has been displaced in the direction of advancement. Then, one of the possibilities already described will be triggered by the subsequent comparison.

Following each stroke of the machine, the counter 10 is set back by the return device 14 to a value of 0, while a new counting process is initiated at the same time.

When a hose section 1 is lacking in the continuous supply, a shift pulse will be triggered, nevertheless, by the pulse former 12, so that a gap will be formed in the slide register 16, whereby the signal of a defect as given by the light sensors 5 are neutralized. When a defect-indicating signal is triggered, it will be processed in a control device 20, whereby one of the two measures as described earlier will be initiated. The control device 20 comprises a control system 21 and a program storage 22. In the program storage 22, it is possible, depending on its capacity, that various programs may be stored, whereby various measures are initiated by the control system 21 depending on the magnitude of the mistake and/or on the site of the defect, whenever a defect appears. The measures that may be initiated, have been mentioned before, by way of examples. When a signal of a defect that brings about the shut-down of the machine, is transmitted, there is the possibility of a correction during a shutdown of this kind, in such a way that either the hose section 1 triggering the signal is moved manually into its nominal position, or else is pulled out of the machine. In order that no signal of a defect may be generated during the subsequent comparison, a read-in device 23 has been provided that consists of control members that are not explained in any detail, and of a control system 24. When a hose section 1 is pulled out, the remaining hose sections which stay in the machine, are picked up by the read-in device 23 and their arrangement is transmitted to the slide register 16. In that way, the lacking hose sections 1 are treated as vacancies. The actual position of each bag is therefore given a nominal position for the comparison.

The present invention is not restricted to the example of the embodiment presented, and it therefore is intended to encompass within the appended claims all changes and modifications within the scope of the present invention.

We claim:

1. A method for the production control of a machine for processing a series of work pieces, which comprises the steps of:

successively positioning the work pieces at an entrance to the machine such that the work pieces initially are in a normal spaced relationship corresponding to a feed stroke of the machine;

incrementally advancing the work pieces through a plurality of sensing sites in the machine;

scanning for the presence or absence of one edge of each work piece at each said sensing site, each sensing site being spaced apart a distance essentially corresponding to the feed stroke of the machine;

generating signals indicative of actual positions of the work pieces at each sensing site in response to the scanning for the presence or absence of the one edge of each work piece;

comparing the generated signals to a nominal value; and generating a control signal when one of the edge actual position-indicating signals differs from the nominal value.

2. The method in accordance with claim 1, which comprises the additional step of neutralizing the potential generation of a control signal which would be caused by the removal of a work piece from the machine by adopting the actual value of a signal resulting therefrom as the nominal value.

3. The method in accordance with claim 1, wherein the leading edge of each work piece is scanned.

4. The method in accordance with claim 3, wherein the leading edge is scanned in two spots located at a transverse distance from one another.

5. The method in accordance with claim 1, which comprises the additional step of stopping the machine in response to the control signal.

6. The method in accordance with claim 1, which comprises the additional step of operating the machine at a reduced speed in response to the control signal.

7. The method in accordance with claim 1, which comprises the additional step of:

establishing a first monitoring position in the machine at a point spaced from the entrance to the machine by an amount less than the nominal spacing of the work pieces, to provide a tolerance allowed in the positions of the work pieces as the work pieces are advanced through the machine.

8. The method in accordance with claim 1, which comprises the additional step of using a first edge-scanning of an incoming work piece to trigger subsequent comparisons of nominal and actual values.

9. The method in accordance with claim 8, which comprises the additional step of:

utilizing the first edge-scanning of an incoming work piece to produce a signal corresponding to the nominal value.

10. The method in accordance with claim 9, which comprises the additional steps of:

feeding the signals produced by scanning at the spaced positions in the machine to respective ones of a plurality of comparator devices;

utilizing the first edge-scanning of each incoming work piece to produce a signal representative of a nominal value for that work piece; and sequentially stepping the signals produced by edge-scanning the incoming work-pieces through the comparator devices as the work pieces are advanced through the machine.

* * * * *